US011043114B2

(12) United States Patent
Candelore et al.

(10) Patent No.: US 11,043,114 B2
(45) Date of Patent: Jun. 22, 2021

(54) NETWORK CONFIGURABLE REMOTE CONTROL BUTTON FOR DIRECT APPLICATION LAUNCH

(71) Applicant: Sony Corporation, Tokyo (JP)

(72) Inventors: Brant Candelore, Escondino, CA (US); Mahyar Nejat, La Jolla, CA (US)

(73) Assignee: Sony Group Corporation, Tokyo (JP)

( * ) Notice: Subject to any disclaimer, the term of this patent is extended or adjusted under 35 U.S.C. 154(b) by 0 days.

(21) Appl. No.: 16/276,454

(22) Filed: Feb. 14, 2019

(65) Prior Publication Data

US 2020/0265707 A1 Aug. 20, 2020

(51) Int. Cl.
*G08B 21/00* (2006.01)
*G08C 17/00* (2006.01)

(52) U.S. Cl.
CPC ..... *G08C 17/00* (2013.01); *G08C 2201/20* (2013.01)

(58) Field of Classification Search
CPC ..... G08C 17/00
USPC ..... 340/12.24
See application file for complete search history.

(56) References Cited

U.S. PATENT DOCUMENTS 8,558,716 B2 10/2013 Roberts et al.
10,057,647 B1 * 8/2018 Marconcini ..... H04N 21/436
2004/0215816 A1 * 10/2004 Hayes ..... H04L 12/2803 709/238
2007/0067732 A1 * 3/2007 Kang ..... G06F 3/04892 715/767
2008/0010664 A1 * 1/2008 Pelizza ..... H04N 5/44508 725/134
2009/0153289 A1 * 6/2009 Hope ..... G06F 3/04883 340/5.1
2010/0011377 A1 * 1/2010 Imai ..... G06F 9/445 719/318
2011/0321071 A1 * 12/2011 McRae ..... G06Q 30/06 725/5
2012/0260217 A1 * 10/2012 Celebisoy ..... G06F 3/04815 715/836
2013/0311300 A1 * 11/2013 Scarborough ..... G06Q 30/02 705/14.69
2013/0326402 A1 * 12/2013 Riggs ..... H04N 21/4788 715/810
2014/0267032 A1 * 9/2014 Chandel ..... G08C 17/00 345/158
2016/0066053 A1 * 3/2016 Bielman ..... H04N 21/482 725/41
2016/0337712 A1 * 11/2016 An ..... H04N 21/8173

FOREIGN PATENT DOCUMENTS

WO WO2014092817 6/2014

OTHER PUBLICATIONS

Sharp Aquos Remote control http://s3.sharpusa.com/product/datasheet/LC90LE657U.pdf.

* cited by examiner

*Primary Examiner* — Mark S Rushing
(74) *Attorney, Agent, or Firm* — Trellis IP Law Group, PC

(57) ABSTRACT

Implementations generally relate to a network reconfigurable button on a remote control. In some implementations, a method includes receiving a selection of a button on a remote control device. The method further includes accessing a configuration file, wherein the configuration file is associated with the button. The method further includes launching an application based on the configuration file.

14 Claims, 5 Drawing Sheets

100

300

400

500

NETWORK CONFIGURABLE REMOTE CONTROL BUTTON FOR DIRECT APPLICATION LAUNCH

BACKGROUND

Many television operating system (OS) platforms are capable of launching pre-installed and downloadable applications (apps), which may be used for selecting and viewing media content such as movies and television shows, or for such apps as video games. Once an application is on the platform, a user typically needs to navigate the on-screen home or hub menu, and often multiple sub-menus to find and launch an application. If the application is not pre-installed or already downloaded, the user must typically go find the application from the platform website, e.g., an application store, to select the application from a myriad other applications available for the TV platform. It is difficult, time consuming, and tedious for a user to find the application from the platform website and/or to find the application in the various TV menus if downloaded or pre-installed.

SUMMARY

Implementations generally relate to a network reconfigurable button on a remote control. In some implementations, a system includes one or more processors, and includes logic encoded in one or more non-transitory computer-readable storage media for execution by the one or more processors. When executed, the logic is operable to cause the one or more processors to perform operations including receiving a selection of a button on a remote control device; accessing a configuration file, wherein the configuration file is associated with the button; and launching an application based on the configuration file.

With further regard to the system, in some implementations, the button displays a label, and wherein the label is associated with the application. In some implementations, a selection of the button comprises one of a single press, a double press, and a long press. In some implementations, the logic when executed is further operable to cause the one or more processors to perform operations comprising: selecting the application from a plurality of applications; and associating the application with the button. In some implementations, the logic when executed is further operable to cause the one or more processors to perform operations comprising rotating through a plurality of applications, and wherein the application is selected from the plurality of applications. In some implementations, the application is an aggregator of applications. In some implementations, the logic when executed is further operable to cause the one or more processors to perform operations comprising: enabling a user to select an alternative button; and associating the application with the alternative button.

In some embodiments, a non-transitory computer-readable storage medium with program instructions thereon is provided. When executed by one or more processors, the instructions are operable to cause the one or more processors to perform operations including receiving a selection of a button on a remote control device; accessing a configuration file, wherein the configuration file is associated with the button; and launching an application based on the configuration file.

With further regard to the computer-readable storage medium, in some implementations, the button displays a label, and wherein the label is associated with the application. In some implementations, a selection of the button comprises one of a single press, a double press, and a long press. In some implementations, the instructions when executed are further operable to cause the one or more processors to perform operations comprising: selecting the application from a plurality of applications; and associating the application with the button. In some implementations, the instructions when executed are further operable to cause the one or more processors to perform operations comprising rotating through a plurality of applications, and wherein the application is selected from the plurality of applications. In some implementations, the application is an aggregator of applications. In some implementations, the instructions when executed is further operable to cause the one or more processors to perform operations comprising: enabling a user to select an alternative button; and associating the application with the alternative button.

In some implementations, a method includes receiving a selection of a button on a remote control device. The method further includes accessing a configuration file, wherein the configuration file is associated with the button. The method further includes launching an application based on the configuration file.

With further regard to the method, in some implementations, the button displays a label, and wherein the label is associated with the application. In some implementations, a selection of the button comprises one of a single press, a double press, and a long press. In some implementations, the method further includes: selecting the application from a plurality of applications; and associating the application with the button. In some implementations, the method further includes rotating through a plurality of applications, and wherein the application is selected from the plurality of applications.

In some implementations, a remote control device includes a button with a label with one of "App of the Day," "App of the Week," "App of the Month," "Discovery App," "App Discovery," and "Discover App."

A further understanding of the nature and the advantages of particular implementations disclosed herein may be realized by reference of the remaining portions of the specification and the attached drawings.

DETAILED DESCRIPTION

Implementations described herein enable, facilitate, and manage the configuration of a configurable button on a remote control device. Implementations facilitate users in conveniently launching applications on their television using the configurable button on the remote control. In various implementations, a system provides a button on a remote control device in order to directly launch applications. When the system receives a selection of the button by a user, the system accesses a configuration file, where the configuration file is associated with the button. The system then launches an application based on the configuration file.

As described in more detail herein, the system enables different applications to be associated with the same configurable button based on a configuration file unlike conventional buttons that have fixed functionality. The system further enables a user to select and launch one or more of the applications using various selection techniques (e.g., single press, double press, long press, etc.) according to the configuration file.

Figure 1:
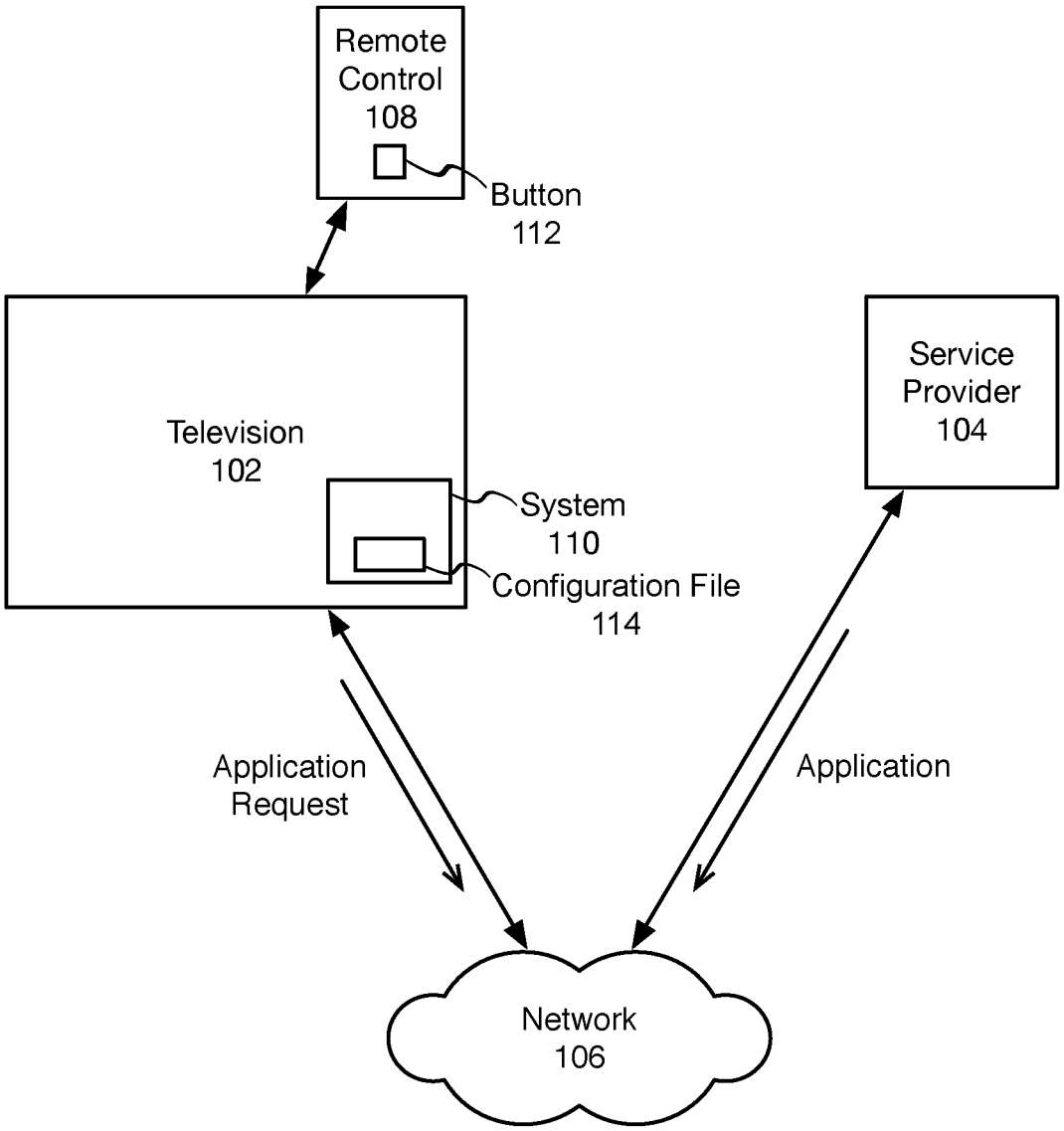
FIG. 1 illustrates a block diagram of an example media environment, which may be used for some implementations described herein.

FIG. 1 illustrates a block diagram of an example media environment 100, which may be used for some implementations described herein. In some implementations, media environment 100 includes a television 102 and a service provider 104, which may communicate with each other via a network 106. In some implementations, the network may be the Internet. In some implementations, the network may include a combination of networks such as the Internet, a wide area network (WAN), a local area network (LAN), a Wi-Fi network, a Bluetooth network, near-field communication (NFC) network, cable network, etc.

In various implementations, a user may use a remote control 108 to communicate with a system 110 associated with television 102. The terms remote control, remote control device, and remote may be used interchangeably. Remote control 108 includes various control buttons such as button 112. For ease of illustration, one button 112 is shown. There may be any number of controls buttons on remote control 108. In various implementations, system 110 may be integrated with television 102, and control television 102. In some alternative implementations, system 110 may also be separate from television 102, e.g., in a set-top box, and still control what gets displayed on the television 102.

In various implementations, button 112 is associated with a configuration file 114 that is accessible by system 110. In this particular example implementation, configuration file 114 is stored at system 110. In some embodiments, configuration file 114 may be stored remotely from system 110 and accessible by system 110.

As described in more detail herein, when a user selects button 112, system 110 accesses configuration file 114, which includes information associated with a particular application. The application may be provided by a service provider such as service provider 104, for example. If the application is already installed on system 110, the system may launch the application in response the user selecting button 112. If the application is not already installed on system 110, the system may fetch, download, and then launch the application in response the user selecting button 112. System 110 may communicate with service provider 104 on behalf of television 102 in order to retrieve the application and any other information for configuring and operating the application. In some implementations, during the installation, the system may require the user to accept the granting of permissions to the app. Various example implementations directed to operations associated with button 112 and configuration file 114 are described in detail herein.

Figure 2:
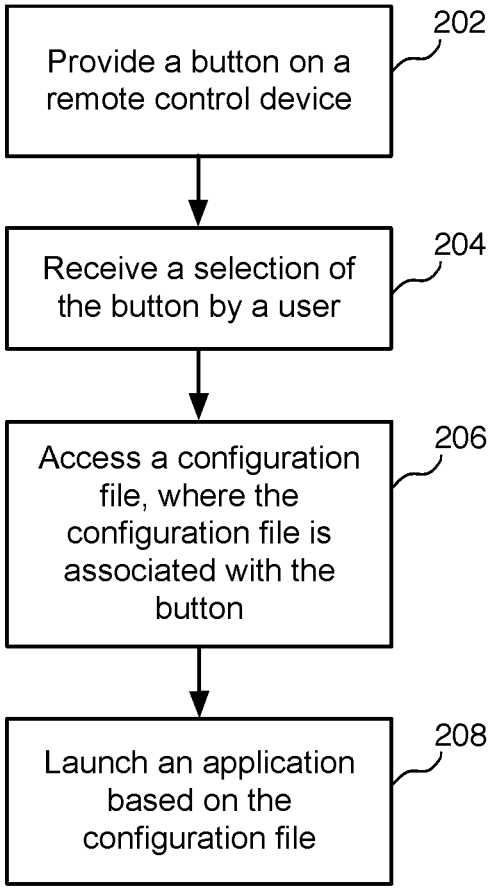
FIG. 2 is an example flow diagram for operating a configurable button on a remote control, according to some implementations.

FIG. 2 is an example flow diagram for operating a configurable button on a remote control, according to some implementations. Referring to both FIGS. 1 and 2, a method is initiated at block 202, where the system such as system 110 provides a button such as button 112 on a remote control device. In various implementations, to provide the button, system 110 configures the button to a particular application. As described in more detail herein, the system may also configure the button to multiple applications and ultimately select one of the applications to be launched. The button is advantageous over conventional, fixed buttons on remote controls that cannot be reconfigured.

Figure 3:
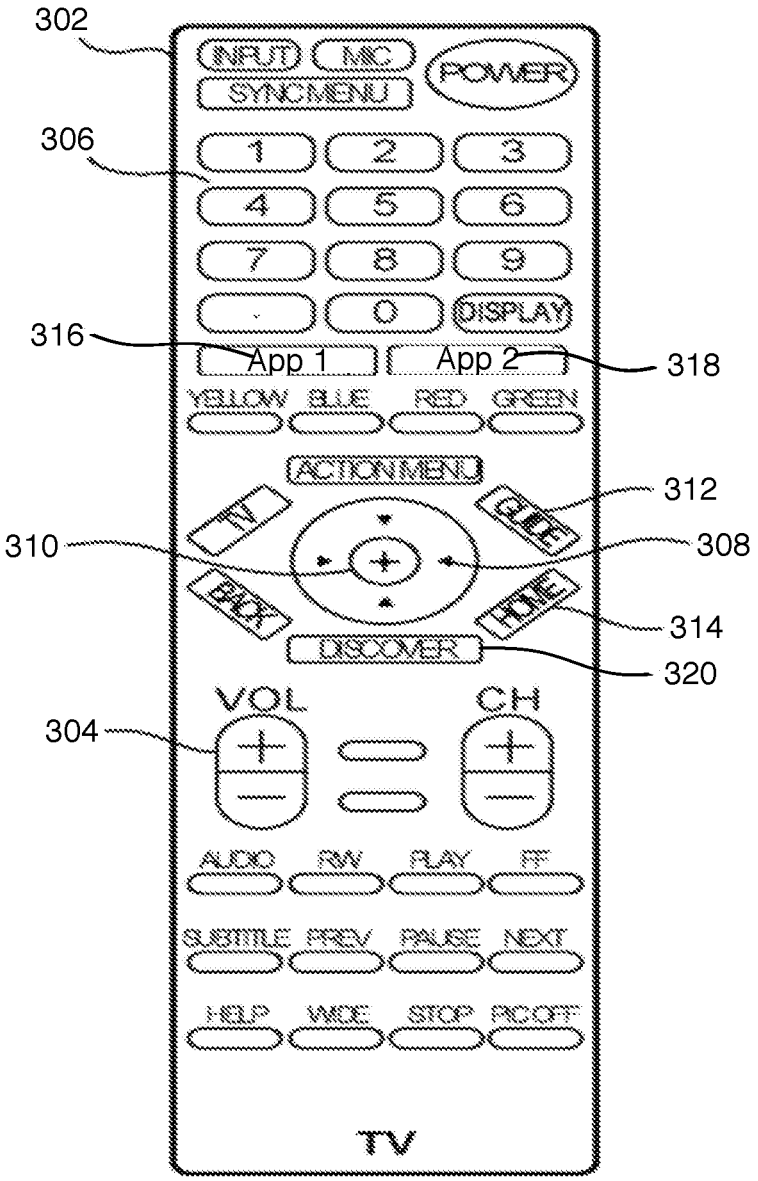
FIG. 3 is a block diagram of an example remote control device with one or more configurable buttons, which may be used for some implementations described herein.

FIG. 3 is an example view of an example remote control 300, according to some implementations. Remote control 300 may be used to implement remote control 108 of FIG. 1. In various implementations, remote control 300 may include one or more internal processors, computer memories, and wireless transmitters such as IR command transmitters to control a device such as television 102 of FIG. 1.

As shown, remote control 300 includes a typically plastic, hand-holdable housing 302 with multiple input keys that can be manipulated by a person to cause wireless commands to be sent from the remote control 300 to television 102 (e.g., to system 110). Volume up and down keys 304 may be manipulated to respectively turn the volume of the speakers of television 102 up and down. An alpha-numeric keypad 306 may be provided on remote control 300 for inputting letters and/or numbers to television 102. Also, a directional input element such as a rocker 308 or directional keys may be provided with each arm of the rocker being manipulable to move a screen cursor up and down and left and right. If desired, a select key 310 may be located in the center of the rocker 308 for input of a "select" command.

Further, in the example shown, remote control 300 may include a guide key 312 manipulable to send a command to present an electronic program guide (EPG) on television 102. Also, a home key 314 may be provided and can be manipulated to invoke a home menu. A special accessibility key may be provided. As shown, many other keys also may be provided, making the task for a blind person to learn the functions of the keys daunting.

In various implementations, the system causes the button to displays a changeable label 316, where the label is associated with an application (e.g., the Application of the day, the Application of the Week, the Application of the Month, Discover Apps, Explore Apps, etc.). In other embodiments, the button label may be fixed. In various implementations, the system may provide multiple buttons such as a second button having a label 318, for example (e.g., labeled App 2). In some implementations, various labels are possible, depending on the particular implementation. For example, the application label may be for an application a period of time, "App of the day," "App of the week," "App of the Month," "App of the Season," "Showcased App," "Discovery App," etc. When two button labels are present and similar, the label could be "App of the Day #1" and "App of the Day #2". Or, one label may be "App of the week" while the other label may be "App of the Month." In some implementations, remote control 300 may include yet another configurable button 320. In this particular example, button 320 is a "Discover" button for discovering and launching other applications listed in the configured file (e.g., configuration file 114 of FIG. 1).

In some implementations, the system may cause a particular application to be the current application to be launched upon selection of the button for a predetermined period of time (e.g., one day, one week, one month, etc.) with an associated expiration date. After the expiration date, the system may rotate in a new application in the place of the previous application or simply replace the application with a different application.

At block 204, the system receives a selection of the button on a remote control device. A user may use various techniques for selecting the button. For example, in some implementations, the selection of the button may include a single press, a double press, and/or a long press. There may be different applications selected by each action. For example, in some implementation, if the user presses the button a single time, the system may launch the application corresponding to the label on the button. If the user presses the button with a long press, the system may show a menu of multiple applications, which the user may have previously designated as ones that were liked and "kept around" for easy launch from the remote control. In some implementations, a subsequent press (e.g., a second press) may result in the system displaying an explanation of the application, or providing other relevant information. For example, explaining how the various "App of" time period will change over time, how they may be kept around and launched using a double press of the button, etc.

In various implementations, the system selects the application from multiple applications that may be sent with the configuration file. In some implementations, the system may select the application from a plurality of applications selectable by the user. The system then associates the application with the button. In various implementations, the system may rotate through multiple applications, and selects the application from the multiple applications so that multiple applications may be promoted and showcased. In some implementations, the system may enable the user to scroll through the list of associated applications to optionally select one to be currently associated with the button. In some implementations, the system may select a small menu of promoted applications, and launch an application from the small menu. In some embodiments, a single press may bring up the small menu, and the user may pick an application from the small menu, and fix the application to a double press of the button.

At block 206, the system accesses a configuration file. In some implementations, the configuration file may be retrieved from the cloud/Internet with every instance of pressing an "App of" button. The file may be also be periodically retrieved (e.g., once a week) and stored locally in the system. If the cloud/Internet is not available, then the local file is used. Alternatively, the configuration file may be stored remotely in the cloud/Internet and always retrieved with no copy stored locally.

In various implementations, the configuration file is associated with the button. In some implementations, the configuration file includes information associated with the application. A minimum data set could be just the application name. For example, for a given system, the application name may be "com.google.android.youtube.tv," for example. An "App of the . . . " button can be associated with an application name, and the Android platform will launch the application. In addition, the configuration file may include configuration information, e.g. to launch the application in full-screen mode, etc.

In some implementations, the configuration file may include information associated with multiple applications associated with a single button. In some implementations, the configuration file may include information associated with multiple buttons, where each button may be associated with one or more applications.

In some implementations, there may be multiple configuration files for different models of TVs, which are shipped with different models of remote controls, and versions of the operating system. It is possible that the configuration files may be targeted. For example, a more youthful household might get a configuration file that might showcase video games or cartoon videos instead of more adult pay-per-view streaming service. In some implementations, the system may store and/or access a different configuration file for each television of multiple televisions. For example, a given household may have multiple televisions (e.g., living room, bedroom, kitchen, etc.). As such, there may be multiple configuration files, where each configuration file is associated with a different television. And, it is possible to target individuals within a household. If the viewer can be identified, then a configuration targeted to that viewer can be created. As such, when a child presses the "App of" button a different app would launch then when the mother pressed the "App of" button. In some implementations, the system may identify each television among a group of televisions based on model number, or other unique identifier (e.g., user identifier, television serial number, etc.). In some implementations, each television may have a distinct remote control. A similar button on each remote control when selected results in the system accessing the corresponding configuration file associated with the button.

At block 208, the system launches an application based on the configuration file. For example, when the user selects the button, the system determines from the configuration file which one or more applications is associated with the button. The system may then launch the application per the configuration file. If the application is not on the device, e.g. the TV, then the platform web service is accessed to download the application and install it on the device. The user may need to agree to grant the application certain permissions in order for the installation to occur.

In some implementations, the application is an aggregator of applications. In some implementations, after being launched by the system, the application may access and display other apps that can be launch. The application, for instance, may bring up a ribbon of applications from which the user may view and select. In this example, the application is a master application (e.g., for searching and accessing content, etc.), and the second application may be an application that provides access to some content.

The system enables the user to select an alternative button (e.g., using a double press or long press). This enables the user to continue launching a particular application that the user likes from the remote control. Otherwise, as other applications get showcased, the user may access the application using the menu system. The alternative button may be in a particular location on the remote, where the user can remember and conveniently select the alternative button. In some implementations the system may enable a cluster of alternative buttons to be configured for applications based on user preference and selection.

The system enables associates the application with the alternative button. In some implementations, the system may remap button 112 in order to associate button 112 with a different application. For example, the system may remap button 112 to a favorite application or preferred application selected by the user. This enables the user to more conveniently launch the favorite or preferred application.

In some implementations, if the system brings up a particular menu (e.g., home menu) or selects particular buttons (e.g., home menu button, etc.), the system may display an on-screen message detailing the current app of the month. For instance, the system may display, "The Showcased App of the month is Crackle. Press Showcased App on the remote control to activate." The system may periodically update the list applications associated with a given button. The system may also periodically select a given application among a set of applications to be the current application associated with the button. In some implementations, the system may enable the user to set or lock the button such that the current application that is associated with the button does not change. In other words, any rotation of applications associated with the button may be halted at least temporarily.

In some implementations, the button may be monetized to generate recurring revenue. In some implementations, the system may enable a third-party service provider to rent access to the button. The application may be a third-party application. For example, a service provider may pay for the system to associate the button with an application provided by the service provider or with an application that accesses content provided by the service provider.

Although the steps, operations, or computations may be presented in a specific order, the order may be changed in particular implementations. Other orderings of the steps are possible, depending on the particular implementation. In some particular implementations, multiple steps shown as sequential in this specification may be performed at the same time. Also, some implementations may not have all of the steps shown and/or may have other steps instead of, or in addition to, those shown herein.

Implementations described herein provide various benefits. For example, implementations facilitate users in conveniently launching applications on their television using a remote.

Figure 4:
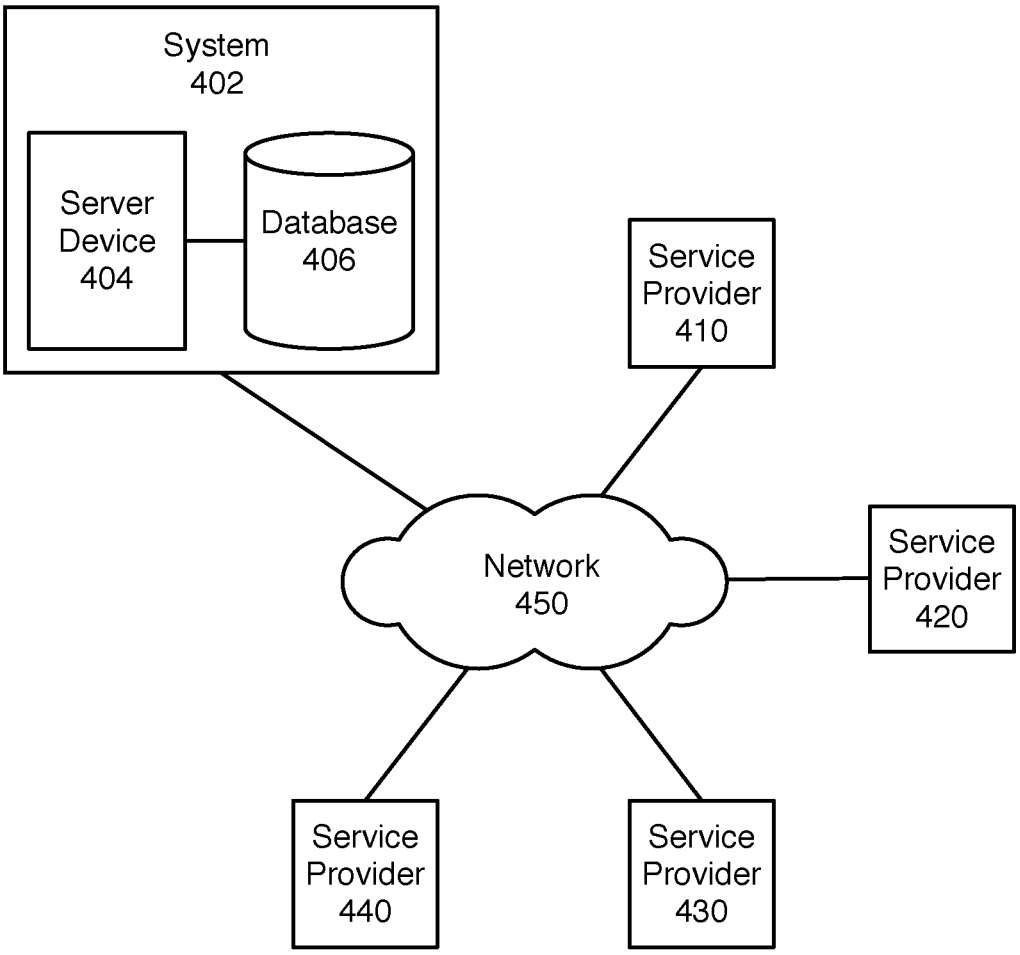
FIG. 4 is a block diagram of an example network environment, which may be used for some implementations described herein.

FIG. 4 is a block diagram of an example network environment, which may be used for implementations described herein. In some implementations, network environment 400 includes a system 402, which includes a server device 404 and a database 406. System 402 may be used to implement system 110 of FIG. 1.

Network environment 400 also includes service providers 410, 420, 430, and 440, which may communicate with system 402 and/or may communicate with each other directly or via system 402. Network environment 400 also includes a network 450 through which system 402 and service providers 410, 420, 430, and 440 communicate. Network 450 may be any suitable communication network such as a Wi-Fi network, Bluetooth network, the Internet, etc. In various implementations, system 402 may be used to implement embodiments described herein.

For ease of illustration, FIG. 4 shows one block for each of system 402, server device 404, and network database 406, and shows four blocks for service providers 410, 420, 430, and 440. Blocks 402, 404, and 406 may represent multiple systems, server devices, and databases. Also, there may be any number of client devices. In other implementations, network environment 400 may not have all of the components shown and/or may have other elements including other types of elements instead of, or in addition to, those shown herein.

While server 404 of system 402 performs embodiments described herein, in other embodiments, any suitable component or combination of components associated with server device 404 or any suitable processor or processors associated with server device 404 may facilitate performing the embodiments described herein.

Implementations may apply to any network system and/or may apply locally for an individual system or device. For example, implementations described herein may be implemented by system 402 and/or any service providers 410, 420, 430, and 440. System 402 may perform the implementations described herein on a stand-alone computer, tablet computer, smartphone, etc. System 402 and/or any of service providers 410, 420, 430, and 440 may perform implementations described herein individually or in combination with other devices.

In the various implementations described herein, a processor of system 402 and/or a processor of any service providers 410, 420, 430, and 440 causes the elements described herein (e.g., information, etc.) to be displayed in a user interface on one or more display screens.

Figure 5:
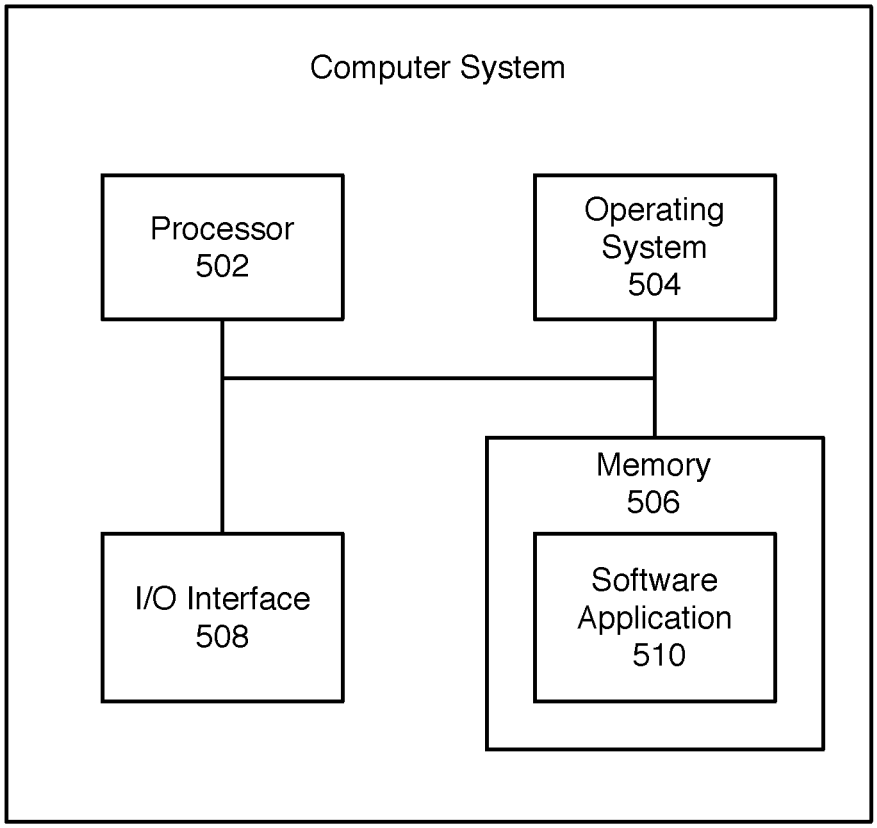
FIG. 5 is a block diagram of an example computer system, which may be used for some implementations described herein.

FIG. 5 is a block diagram of an example computer system 500, which may be used for some implementations described herein. For example, computer system 500 may be used to implement system 110 of FIG. 1, as well as to perform implementations described herein. In some implementations, computer system 500 may include a processor 502, an operating system 504, a memory 506, and an input/output (I/O) interface 508. In various implementations, processor 502 may be used to implement various functions and features described herein, as well as to perform the method implementations described herein. While processor 502 is described as performing implementations described herein, any suitable component or combination of components of computer system 500 or any suitable processor or processors associated with computer system 500 or any suitable system may perform the steps described. Implementations described herein may be carried out on a user device, on a server, or a combination of both.

Computer system 500 also includes a software application 510, which may be stored on memory 506 or on any other suitable storage location or computer-readable medium. Software application 510 provides instructions that enable processor 502 to perform the implementations described herein and other functions. Software application may also include an engine such as a network engine for performing various functions associated with one or more networks and network communications. The components of computer system 500 may be implemented by one or more processors or any combination of hardware devices, as well as any combination of hardware, software, firmware, etc.

For ease of illustration, FIG. 5 shows one block for each of processor 502, operating system 504, memory 506, I/O interface 508, and software application 510. These blocks 502, 504, 506, 508, and 510 may represent multiple processors, operating systems, memories, I/O interfaces, and software applications. In various implementations, computer system 500 may not have all of the components shown and/or may have other elements including other types of components instead of, or in addition to, those shown herein.

Although the description has been described with respect to particular embodiments thereof, these particular embodiments are merely illustrative, and not restrictive. Concepts illustrated in the examples may be applied to other examples and implementations.

In various implementations, software is encoded in one or more non-transitory computer-readable media for execution by one or more processors. The software when executed by one or more processors is operable to perform the implementations described herein and other functions.

Any suitable programming language can be used to implement the routines of particular embodiments including C, C++, Java, assembly language, etc. Different programming techniques can be employed such as procedural or object oriented. The routines can execute on a single processing device or multiple processors. Although the steps, operations, or computations may be presented in a specific order, this order may be changed in different particular embodiments. In some particular embodiments, multiple steps shown as sequential in this specification can be performed at the same time.

Particular embodiments may be implemented in a non-transitory computer-readable storage medium (also referred to as a machine-readable storage medium) for use by or in connection with the instruction execution system, apparatus, or device. Particular embodiments can be implemented in the form of control logic in software or hardware or a combination of both. The control logic when executed by one or more processors is operable to perform the implementations described herein and other functions. For example, a tangible medium such as a hardware storage device can be used to store the control logic, which can include executable instructions.

Particular embodiments may be implemented by using a programmable general purpose digital computer, and/or by using application specific integrated circuits, programmable logic devices, field programmable gate arrays, optical, chemical, biological, quantum or nanoengineered systems, components and mechanisms. In general, the functions of particular embodiments can be achieved by any means as is known in the art. Distributed, networked systems, components, and/or circuits can be used. Communication, or transfer, of data may be wired, wireless, or by any other means.

A "processor" may include any suitable hardware and/or software system, mechanism, or component that processes data, signals or other information. A processor may include a system with a general-purpose central processing unit, multiple processing units, dedicated circuitry for achieving functionality, or other systems. Processing need not be limited to a geographic location, or have temporal limitations. For example, a processor may perform its functions in "real-time," "offline," in a "batch mode," etc. Portions of processing may be performed at different times and at different locations, by different (or the same) processing systems. A computer may be any processor in communication with a memory. The memory may be any suitable data storage, memory and/or non-transitory computer-readable storage medium, including electronic storage devices such as random-access memory (RAM), read-only memory (ROM), magnetic storage device (hard disk drive or the like), flash, optical storage device (CD, DVD or the like), magnetic or optical disk, or other tangible media suitable for storing instructions (e.g., program or software instructions) for execution by the processor. For example, a tangible medium such as a hardware storage device can be used to store the control logic, which can include executable instructions. The instructions can also be contained in, and provided as, an electronic signal, for example in the form of software as a service (SaaS) delivered from a server (e.g., a distributed system and/or a cloud computing system).

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope to implement a program or code that can be stored in a machine-readable medium to permit a computer to perform any of the methods described above.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

What is claimed is:

1. A system comprising:

one or more processors; and logic encoded in one or more non-transitory computer-readable storage media for execution by the one or more processors and when executed operable to cause the one or more processors to perform operations comprising:

receiving a selection of a button on a remote control device, wherein the selection of the button comprises one of a single press, a double press, and a long press;

accessing a configuration file at a television in response to receiving the selection of the button on the remote control device, wherein the configuration file is associated with the button, and wherein the configuration file comprises information associated with a plurality of applications associated with the button;

rotating through the plurality of applications;

receiving a selection of an application from the plurality of applications;

associating the application with the button, wherein the application is associated as a current application of the plurality of applications to be launched upon selection of the button, wherein the button displays a label, and wherein the label indicates the application as the current application;

launching the application based on the configuration file and selection of the button; and enabling the application to be launched for a predetermined period of time with an associated expiration date.

2. The system of claim 1, wherein the label is changeable.

3. The system of claim 1, wherein the remote control device comprises a button with a label with one of "App of the Day," "App of the Week," "App of the Month," "Discovery App," "App Discovery," and "Discover App".

4. The system of claim 1, wherein the logic when executed is further operable to cause the one or more processors to perform operations comprising selecting the application from a plurality of applications.

5. The system of claim 1, wherein the application is an aggregator of applications.

6. The system of claim 1, wherein the logic when executed is further operable to cause the one or more processors to perform operations comprising:

enabling a user to select an alternative button; and associating the application with the alternative button.

7. A non-transitory computer-readable storage medium with program instructions stored thereon, the program instructions when executed by one or more processors are operable to cause the one or more processors to perform operations comprising:

receiving a selection of a button on a remote control device, wherein the selection of the button comprises one of a single press, a double press, and a long press;

accessing a configuration file at a television in response to receiving the selection of the button on the remote control device, wherein the configuration file is associated with the button, and wherein the configuration file comprises information associated with a plurality of applications associated with the button;

rotating through the plurality of applications;

receiving a selection of an application from the plurality of applications;

associating the application with the button, wherein the application is associated as a current application of the plurality of applications to be launched upon selection of the button, wherein the button displays a label, and wherein the label indicates the application as the current application;

launching the application based on the configuration file and selection of the button; and enabling the application to be launched for a predetermined period of time with an associated expiration date.

8. The computer-readable storage medium of claim 7, wherein the label is changeable.

9. The computer-readable storage medium of claim 7, wherein the instructions when executed are further operable to cause the one or more processors to perform operations comprising selecting the application from a plurality of applications.

10. The computer-readable storage medium of claim 7, wherein the application is an aggregator of applications.

11. The computer-readable storage medium of claim 7, wherein the instructions when executed is further operable to cause the one or more processors to perform operations comprising:

enabling a user to select an alternative button; and associating the application with the alternative button.

12. A computer-implemented method comprising:

receiving a selection of a button on a remote control device, wherein the selection of the button comprises one of a single press, a double press, and a long press;

accessing a configuration file at a television in response to receiving the selection of the button on the remote control device, wherein the configuration file is associated with the button, and wherein the configuration file comprises information associated with a plurality of applications associated with the button;

rotating through the plurality of applications;

receiving a selection of an application from the plurality of applications;

associating the application with the button, wherein the application is associated as a current application of the plurality of applications to be launched upon selection of the button, wherein the button displays a label, and wherein the label indicates the application as the current application;

launching the application based on the configuration file and selection of the button; and enabling the application to be launched for a predetermined period of time with an associated expiration date.

13. The method of claim 12, wherein the label is changeable.

14. The method of claim 12, further comprising selecting the application from a plurality of applications.

* * * * *